United States Patent [19]

Aalpoel

[11] 3,938,702

[45] Feb. 17, 1976

[54] DEVICE FOR DELIVERING OBJECTS OF NON-UNIFORM THICKNESS

[75] Inventor: Marten Geert Aalpoel, Nuenen, Netherlands

[73] Assignee: Arenco P.M.B. B.V., Best, Netherlands

[22] Filed: Apr. 8, 1974

[21] Appl. No.: 458,899

[30] Foreign Application Priority Data

Apr. 11, 1973 Netherlands ..... 7305092

[52] U.S. Cl. ..... 221/238

[51] Int. Cl.[2] ..... B65H 5/16

[58] Field of Search ..... 221/259, 262, 238, 268, 221/171, 172, 175, 178, 200, 225, 272–275, 270

[56] References Cited

UNITED STATES PATENTS

| | | | |
|---|---|---|---|
| 3,002,654 | 10/1961 | Maximoff et al. | 221/225 |
| 3,161,320 | 12/1964 | Swanson | 221/270 X |
| 3,220,605 | 11/1965 | Casey | 221/259 X |

*Primary Examiner*—Stanley H. Tollberg
*Attorney, Agent, or Firm*—Snyder, Brown and Ramik

[57] ABSTRACT

A device for delivering one by one an essentially rectangular object of lenticular cross section from a pile of said objects having non-uniform, different thicknesses, said device comprising a plate supporting the pile, a stop surface standing on the supporting plate in front of one transverse edge of the objects and terminating at a given distance above the supporting plate to form a delivery gap and a catch operating in a direction towards the stop surface for conducting away the lowermost object through the gap in a direction of length wherein the improvement comprises one upright peripheral strip of the stop surface extending down to the supporting plate and at right angles to the stop surface, along the other peripheral strip thereof, a second stop surface is provided which is set back at the level of the gap over at least the width of one peripheral strip, the distance between the second stop surface and one peripheral strip being smaller than the width of the object; and a pressing member acting substantially at right angles to the catch pushes each time the lowermost object against the set-back surface.

11 Claims, 5 Drawing Figures

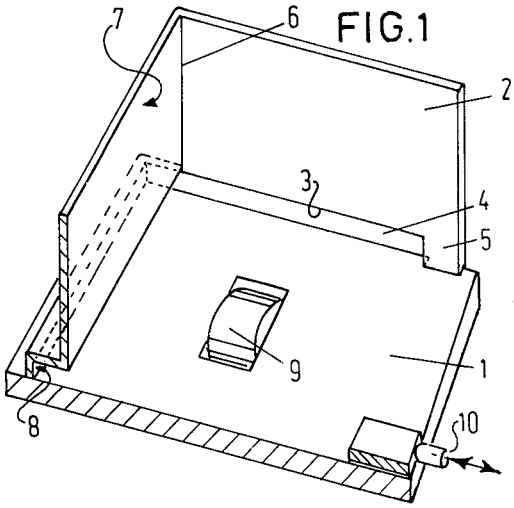
FIG.1
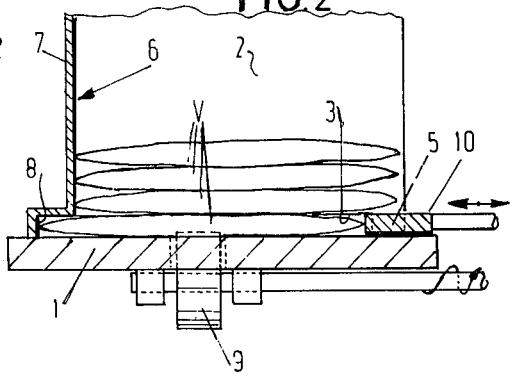
FIG.2
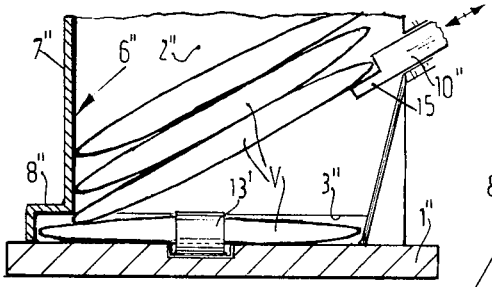
FIG.5
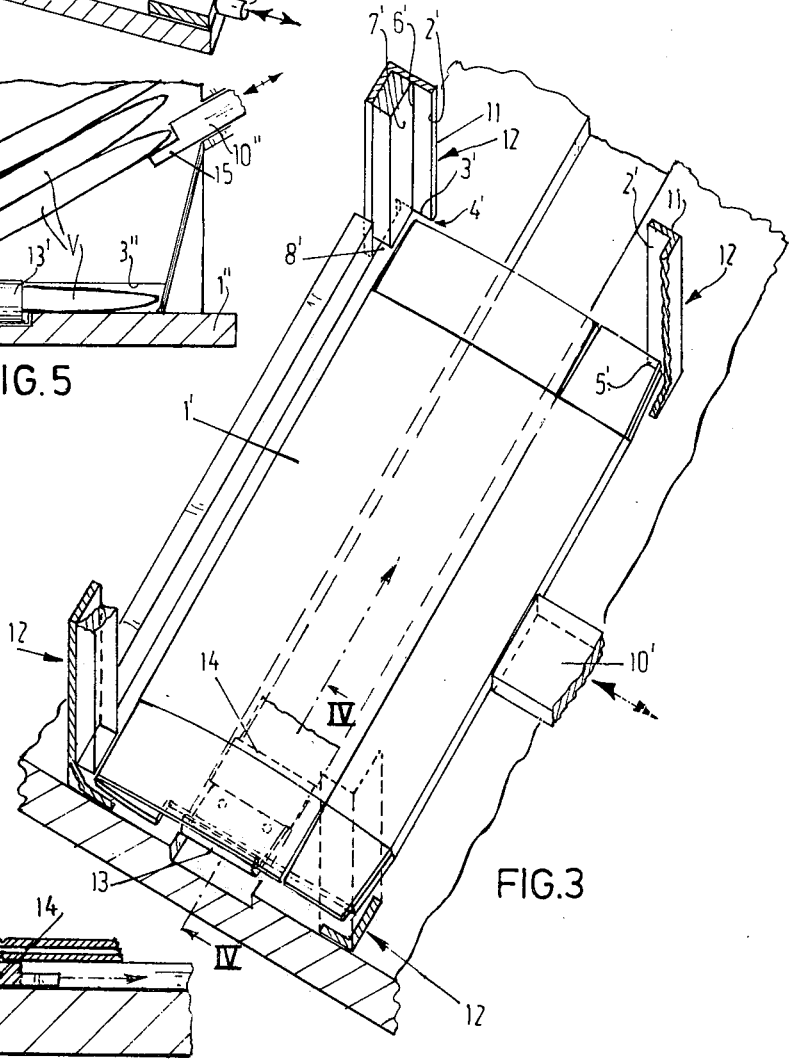
FIG.3
FIG.4
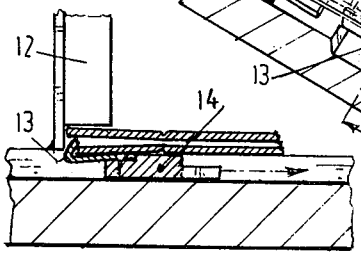

DEVICE FOR DELIVERING OBJECTS OF NON-UNIFORM THICKNESS

The invention relates to a device for the repeated delivery of a mainly rectangular object of lenticular cross-section from a stack of said objects having non-uniform and relatively different thicknesses, said device comprising a stack-supporting plate, a stop surface standing on said supporting plate in front of one transverse edge of the objects and terminating at a given distance above the supporting plate to form a delivery gap and a catch acting towards said stop surface for conducting the lowermost object through said gap.

The known devices of the type set forth operate very effectively as long as objects of thicknesses varying with very small tolerances have to be delivered. However, if flat, box-shaped objects, for example, a plano intended for making a flap box, already folded and glued into a box have to be conducted one by one to a machine arranged behind said device for making flap boxes, the differences in thickness owing to the resilience of the plano material may be so great that either the delivery stops or more than one object are delivered simultaneously.

The invention has for its object to provide a device of the kind set forth, in which said disadvantage does not occur and which is characterized in that one standing peripheral strip of the stop surface extends down to the supporting plate and a second stop surface is arranged at right angles to said first stop surface along the other peripheral strip thereof, said second stop surface being set back at the level of the gap over the width of one peripheral strip, the distance between the second stop surface and one peripheral strip being smaller than the width of the object and in that a pressing member acting substantially at right angles to the catch urges every lowermost object against said set-back surface.

Since the longitudinal edge of the object owing to its lenticular section has a slightly wedge-shaped form, the separation of the lowermost object from the superjacent objects of the stack will be performed in a reliable manner. As soon as the more or less arcuate front edge of the object has been moved to the side of one peripheral strip of the foremost stop surface extending down to the supporting plate, that is to say, when it is completely located in front of the delivery gap, the path is free for delivering the lowermost object in the longitudinal sense. The gap-shaped passage need not have accurate dimensions and it is sufficient to adapt the height of the gap to the expected maximum thickness of the objects. For matching the width of the objects the distance between the second stop surface and one peripheral strip is adjustable in accordance with the invention.

When the catch is formed by a rotating conveyor roller, which is constantly in contact with the bottom surface of the lowermost object, the pressing member determines the instant of delivery of said object because after the object is pressed aside, it emerges from below the stack in the direction of length.

For given objects suitable for this purpose the catch may be formed by a stop reciprocating synchronously with the pressing member and gripping behind the rear transverse edge of the object.

The invention will now be described more fully with reference to three embodiments of the invention.

FIG. 1 is a perspective view of a first embodiment of the invention.

FIG. 2 is a cross sectional view of the device shown in FIG. 1.

FIG. 3 is a perspective view of a second embodiment of the invention.

FIG. 4 shows a detail of the catch of the second embodiment in a longitudinal sectional view.

FIG. 5 shows a cross sectional view of a third embodiment of the invention, in which the objects are supported in an inclined position.

The embodiment shown in FIGS. 1 and 2 comprises a supporting plate 1 having perpendicularly arranged on it a stop surface 2, the lower edge 3 of which terminates at a given distance above the supporting plate 1 in order to form a free gap 4. One peripheral strip 5, on the right hand side of FIG. 1, is prolonged down to the supporting plate 1, whereas along the other peripheral strip 6 at right angles to the stop surface 2 a second stop surface 7 is provided. This second stop surface 7 is set back below immediately above the supporting plate 1 at the level of the gap 4. The set-back portion 8 covers at least a distance behind the stop surface 7 which corresponds to the width of the peripheral strip 5. In the stop surface is provided a catch, which is formed in this embodiment by a rotatable roller 9 (see FIG. 2). The direction of rotation of the roller 9 is chosen so that the catch operates in the direction of the stop surface 2. At right angles to said direction of operation is arranged a pressing member 10 so as to be able to reciprocate.

This embodiment operates as follows. A plurality of objects V of lenticular section (see FIG. 2) are piled up on the supporting plate 1. By their front transverse edges they engage the stop surface 2 and by the wedge-shaped side edge determined by the lenticular section they are in contact with the stop surface 7. The lowermost object of the stack will initially lie directly beneath the other objects. The pressing member 10, which applies to the lateral edge of the object remote from the stop surface 7, pushes the lowermost object to the left as seen in FIG. 2, which is allowed by the set-back stop surface 8 with respect to the stop surface 7. The lowermost object is then brought right in front of the gap 4 and is moved from below the stack by the action of the catcher 9 through the delivery gap 4.

The embodiment shown in FIGS. 3 and 4 differs from the embodiment described above in that the stop surface 2′ is formed by the facing flanges 11 of the angular profiles 12 grouped around the stack of objects and serving as guide elements. It should be noted that the two angular profiles shown on the left-hand bottom side of FIG. 3 are partly shown in full and partly in dotted lines for the sake of clarity of the drawing. The stop surface 7′ is formed by a rectangle-section bar arranged in the left-hand profiles and terminating together with the flange 11 of the left-hand top profile in FIG. 3 at a short distance above the supporting plate 1′. The stop surface 8′ set back with respect to the stop surface 7′ is thus formed by the lower part of the other flange of the two left-hand angular profiles.

The catch is formed by a hook 13, engaging the transverse rear edge of the object and arranged resiliently on a slide 14 adapted to move in a slot of the supporting plate 1′ (see FIG. 4). Transversely of the direction of operation of said catch is adapted to reciprocate a pressing member 10′. The movements of these two members are synchronized in this embodiment so that after the pressing member 10' has pressed the lowermost object aside the catch pushes this object from beneath the stack.

The second embodiment is particularly suitable for delivering one by one plano's folded and glued to a box, more particularly flap boxes to the subsequent working stations. Owing to the resilient action of the plano material the central portion of the box-shaped plano has a lenticular cross section, the left-hand and right-hand edges having the shape of a wedge. The over-all thickness of such a box-shaped plano is, however, not defined and dependent upon the number of superjacent objects, the weight of which more or less flattens the plano. The end flaps of the plano projecting at the front and rear edges have unequal widths owing to the further folding (see FIG. 4). The stroke of the catch of the second embodiment is adjusted so that the hook 13 engages only the lower, less broad flap so that the hook will never take along the penultimate lower object. FIG. 4 shows only one object.

To overcome above mentioned difficulty it is advantageous to stack the objects in an inclined way as shown in FIG. 5. Therefore the pressing member 10'' is located a certain distance above the support plate 1'', whilst the outer end 15 of said member protudes under the edge of objects opposite the edge near the set-back stop surface 8''. The outer end of the pressing member is stepped, such, that by moving said member in the direction of the stop surface 8'', the lowermost object is pressed against the surface 8''. By the return movement the lowermost object falls down whilst the other objects are retained by the stepped lip of the pressing member. Due to the inclination, enough space is left in order to prevent that the hook 13' will engage more than one object.

It is not necessary that member 10'' is provided with a stepped lip 15. The member may include a fixed portion supporting the pile and an active portion, moving alternately to and from the setback surface 8''. So urging the lowermost object against said surface which object simultaneously falls down as its edge passes the fixed portion of the member.

What is claimed is:

1. A device for delivering objects of non-uniform thickness one by one from a pile of such objects, comprising in combination:

a generally horizontal plate for supporting the pile of objects;

first stop surface means disposed in upstanding relation to said plate for engaging one side of the pile of objects;

second stop means disposed in upstanding relation to said plate and at right angles to the first stop surface means, said second stop surface means presenting first abutment means for engaging a side of the pile of objects and second abutment means, offset from the first abutment means, for allowing the lowermost object in the pile to be displaced partially beneath the first abutment means;

said first stop surface means having a delivery gap adjacent said plate and extending from said second abutment means outwardly from beneath said first abutment means to a position allowing displacement of the lowermost object only when such lowermost object is displaced partially beneath said first abutment means and into engagement with said second abutment means;

pusher means reciprocable toward and away from said second stop surface means to displace a lowermost object against said second abutment means; and feed means spaced from said first stop surface means and aligned substantially centrally with respect to said delivery gap, said feed means engaging a lowermost, displaced object for delivering such lowermost object through said delivery gap.

2. A device as defined in claim 1 wherein said first and second stop surface means include at least three L-shaped posts upstanding from said plate and disposed at the apices of a right triangle, one post being common to both stop surface means.

3. A device as defined in claim 2 wherein one flange of said one post defines part of said second abutment means and the other flange of said one post is cut away ajacent said plate to define part of said delivery gap.

4. A device as defined in claim 3 wherein said one flange is provided with a thickened portion commencing in spaced relation to said plate and defining part of said first abutment means.

5. A device as defined in claim 1 wherein said feed means comprises a roller projecting through said plate and means for rotating said roller to feed an object toward said first stop surface means.

6. A device as defined in claim 1 wherein said feed means comprises a member reciprocable toward and away from said delivery gap and including a catch projecting above said plate to engage an edge of a lowermost object.

7. A device as defined in claim 6 wherein said pusher means and said feed means are actuated alternately to push a lowermost object against said second abutment means and then feed such displaced, lowermost object through said delivery gap.

8. A device as defined in claim 2 wherein said feed means comprises a member reciprocable toward and away from said delivery gap and including a catch projecting above said plate to engage an edge of a lowermost object.

9. A device as defined in claim 8 wherein said pusher means and said feed means are actuated alternately to push a lowermost object against said second abutment means and then feed such displaced, lowermost object through said delivery gap.

10. A device as defined in claim 1 wherein said pusher means is angled downwardly toward said second abutment means.

11. A device as defined in claim 10 wherein said pusher means terminates in a stepped surface supporting the pile of objects.

* * * * *